US007168598B2

(12) United States Patent
Gueret

(10) Patent No.: US 7,168,598 B2
(45) Date of Patent: Jan. 30, 2007

(54) DEVICE FOR DISPENSING A PRODUCT

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 487 days.

(21) Appl. No.: 10/232,511

(22) Filed: Sep. 3, 2002

(65) Prior Publication Data

US 2003/0057235 A1 Mar. 27, 2003

(30) Foreign Application Priority Data

Sep. 4, 2001 (FR) ..... 01 11424

(51) Int. Cl.
*B65D 47/00* (2006.01)
*B67D 3/00* (2006.01)

(52) U.S. Cl. ..... 222/548

(58) Field of Classification Search ..... 222/519, 222/525, 536, 537, 545, 548, 549, 553, 182
See application file for complete search history.

(56) References Cited

U.S. PATENT DOCUMENTS 1,524,131 A * 1/1925 Haskell ..... 222/519
2,778,547 A * 1/1957 Atterby ..... 222/553
2,839,227 A 6/1958 Wilson et al.
3,263,873 A * 8/1966 Armour ..... 222/484
3,355,072 A * 11/1967 Sheppard et al. ..... 222/211
3,610,480 A * 10/1971 Lipfert et al. ..... 222/402.21
4,301,950 A * 11/1981 Funfstuck ..... 222/548
4,412,634 A 11/1983 Bennett
4,420,098 A 12/1983 Bennett
4,730,751 A * 3/1988 Mackles et al. ..... 222/211
4,878,604 A 11/1989 Barriac
5,265,770 A * 11/1993 Matkovich et al. .... 222/189.06
5,509,551 A 4/1996 Terrell, II
5,582,315 A * 12/1996 Reid ..... 220/254.4

(Continued)

FOREIGN PATENT DOCUMENTS

DE 42 41 137 6/1994

(Continued)

OTHER PUBLICATIONS

Laid-open Gazette of Japanese Patent Application corresponding to JP 08-026315.

(Continued)

*Primary Examiner*—Huyen Le
(74) *Attorney, Agent, or Firm*—Finnegan Henderson Farabow Garrett & Dunner, L.L.P.

(57) ABSTRACT

A device for dispensing a product may comprise a variable-volume receptacle for containing the product and a dispenser head associated with the receptacle. The dispenser head may be rotatable about an axis of rotation. The device may further comprises an outlet orifice in the dispenser head and a dip tube configured to extend into the receptacle. The dispenser head may be movable between a dispensing position in which flow communication between the outlet orifice and an inside of the receptacle is established, and a closed position in which flow communication between the outlet orifice and the inside of the receptacle is interrupted. The product may be dispensed from the outlet orifice in response to a reduction in the volume of the inside of the receptacle.

49 Claims, 5 Drawing Sheets

U.S. PATENT DOCUMENTS

| | | | |
|---|---|---|---|
| 6,045,008 | A | 4/2000 | González Fernández et al. |
| 6,073,757 | A | 6/2000 | Kornick et al. |

FOREIGN PATENT DOCUMENTS

| | | |
|---|---|---|
| DE | 42 41 437 | 6/1994 |
| EP | 0 601 487 | 6/1994 |
| FR | 789 959 | 11/1935 |
| FR | 969 390 | 12/1950 |
| FR | 2 574 760 | 6/1986 |
| GB | 2 328 433 | 2/1999 |
| JP | 60-175057 | 11/1985 |
| JP | 60-186053 | 12/1985 |
| JP | 63-3953 | 1/1988 |
| JP | 01-96856 | 6/1989 |
| JP | 05-310261 | 11/1993 |
| JP | 06-72881 | 10/1994 |
| JP | 07-40484 | 7/1995 |
| JP | 07-42750 | 8/1995 |
| JP | 08-11961 | 1/1996 |
| JP | 08-026315 | 1/1996 |
| JP | 63-7660 | 1/1998 |
| JP | 10-181783 | 7/1998 |
| JP | 11-342968 | 12/1999 |
| KR | 1995-11282 | 5/1995 |
| KR | 2001-25270 | 4/2001 |
| WO | WO 98/02363 | 1/1998 |

OTHER PUBLICATIONS

Laid-open Gazette of Korean Patent Application corresponding to KR 2001-25270.

Laid-open Gazette of Korean Patent Application corresponding to KR 1995-11282.

Notice to submit Response issued by KIPO in KR Appln. No. 10-2002-53096; and its English language translation.

English language Derwent Abstract of DE 42 41 137, Jun. 9, 1994.

English language Derwent Abstract of DE 42 41 437, Jun. 9, 1994.

English language Derwent Abstract of EP 0 601 487, Jun. 15, 1994.

English language Derwent Abstract of FR 2 574 760, Jun. 20, 1986.

* cited by examiner

DEVICE FOR DISPENSING A PRODUCT

The present invention relates to devices for packaging and dispensing a product, such as a liquid or a powder. For example, the product could be a body lotion, a makeup-removing oil, a shampoo, a liquid soap, and/or a hair care product.

BACKGROUND OF THE INVENTION

Packaging and dispenser devices are known that comprise a container provided on top with a pump that has a pushbutton and a horizontal outlet channel. In such devices, the pushbutton can be held securely in its closed position by being pushed into the body of the pump and then turned about a vertical axis of rotation. Such devices, however, may not give full satisfaction for several reasons.

In order to dispense a large amount of product it may be necessary to actuate the pushbutton several times or else to fit the container with a pump that delivers a large quantity of product each time the pushbutton is pressed. In some cases, however, the quantity dispensed can be excessive.

Furthermore, the area of the pushbutton on which the user presses may be relatively far away from the body of the container when the pushbutton is at rest, given the amplitude of pushbutton displacement. With large containers, it may become difficult to use the same hand both to actuate the pump and to hold the container.

In addition, in order to bring the pushbutton into its closed position, the user may need to dispense a dose of the product, which may not be needed and thus not used.

Finally, when the pushbutton is released, the product may remain in the outlet channel of the pushbutton and then escape onto the container and soil it.

SUMMARY OF THE INVENTION

There exists a need for a dispensing device that addresses one or more of the above-mentioned drawbacks of known devices. It should be understood, however, that the invention described herein could be practiced without satisfying one or more of the needs described above and/or without fulfilling one or more of the aspects, objects, and/or advantages described herein. In addition, it should be understood that the embodiments described herein are merely exemplary.

As embodied and broadly described herein, one aspect of the invention includes a device for dispensing a product that comprises a variable-volume receptacle for containing the product. The receptacle may comprise a body and a bottom surface. The device may also comprise a dispenser head associated with the receptacle. The dispenser head may be rotatable about an axis of rotation. For example, the axis of rotation may be nonperpendicular to and nonparallel to a flat surface when the bottom surface of the receptacle is placed on the flat surface. The device may further comprise an outlet orifice in the dispenser head and a dip tube configured to extend into the receptacle. The dispenser head may be movable between a dispensing position in which flow communication between the outlet orifice and an inside of the receptacle is established, and a closed position in which flow communication between the outlet orifice and the inside of the receptacle is interrupted. The product may be dispensed from the outlet orifice in response to a reduction in the volume of the inside of the receptacle.

In an aspect, the receptacle may contain the product therein. The product may be, for example, a liquid or a powder. Optionally, the product is a cosmetic product, such as, for example, a hair product or a skin product.

In another aspect, the dip tube may comprise an inside section configured so that when the receptacle returns to an initial shape after dispensing product and the receptacle is substantially full, the dip tube is filled with air over a major fraction of its length.

In still another aspect, the device may not include a pump. In other words, the product may be dispensed by decreasing the volume of the inside of the receptacle without the use of an additional pumping mechanism.

In a further aspect, the dispenser head may comprise an outlet channel flow coupled to the outlet orifice. At least a portion the outlet channel may extend in a direction pointing towards the outlet orifice and away from a plane including the bottom surface of the receptacle when the dispenser head is in the closed position. Optionally, the outlet channel may have an end portion that extends in the direction pointing towards the outlet orifice and away from the plane including the bottom surface of the receptacle when the dispenser head is in the closed position.

In another aspect, the axis of rotation of the dispenser head may be in a plane oblique (i.e., neither parallel nor perpendicular) with respect to a plane including the bottom surface of the receptacle. The plane of the axis of rotation optionally may be angled towards the end portion of the outlet channel when the dispenser head is in the dispensing position.

In an aspect, the axis of rotation of the dispenser head may make a nonzero angle of not more than about 45° relative to the vertical when the bottom surface of the receptacle is placed on a horizontal plane surface.

In still another aspect, the dispenser head may be off-center relative to a top portion of the body of the receptacle.

In an aspect, the device may be configured such that a vertical line passing through the outlet orifice and being perpendicular to a plane including the bottom surface of the receptacle may not intersect at least a top portion of the receptacle when the dispenser head is in the dispensing position, and the vertical line may intersect the receptacle when the dispenser head is in the closed position.

In yet another aspect, the dispenser head may be movable from the dispensing position to the closed position by rotating the dispenser head through one half turn about the axis of rotation.

In another aspect, the dispenser head may comprise an outlet channel flow coupled to the outlet orifice. The outlet channel may extend in a direction towards the outlet orifice and towards a plane including the bottom surface of the receptacle when the dispenser head is in the dispensing position.

In a further aspect, the device may include a cap for the dispenser head. Optionally, the cap may be capable of being coupled to the receptacle when the dispenser head is in the closed position. The cap and the dispenser head may be configured such that the cap cannot be coupled to the receptacle when the dispenser head is in the dispensing position.

In still another aspect, the device may include a support removably coupled to the receptacle. The dispenser head may be rotatable relative to the support. The support may be coupled to the body of the receptacle, for example, by one of snap-fastening and being screwed thereon. Alternately, the support may be integral with the body of the receptacle and the dispenser head may be rotatable relative to the support. Optionally, the dispenser head could be fixed to the support by snap-fastening.

In an aspect, the support may include at least one portion in relief enabling the dispenser head to be positioned in a predetermined position. For example, the predetermined position may include at least one of the dispensing position and the closed position. The support may enable the dispenser head to be positioned accurately both in the closed position and in the dispensing position.

The support may include at least one projection and the dispenser head may include at least first and second pairs of ribs. The ribs in the first pair may be configured to be positioned on opposing sides of the projection when the dispenser head is in the dispensing position and the ribs in the second pair may be configured to be positioned on opposing sides of the projection when the dispenser head is in the closed position.

In an aspect, the dip tube may be coupled to the support. Optionally, the support is capable of being removably coupled to the body of the receptacle, the dip tube is coupled to the body of the receptacle, and the dispenser head is on the support.

In another aspect, the receptacle may comprise at least one elastically deformable wall. The at least one elastically deformable wall may be capable of deforming in response to a force and then returning to its initial shape upon removal of the force. Optionally, the receptacle comprises two major faces capable of being squeezed together to decrease the volume of an inside of the receptacle and thereby dispense the product from the receptacle.

In still another aspect, the receptacle may include a bellows to enable the volume of the inside of the receptacle to be varied to thereby dispense product.

In yet another aspect, the dispenser head may be movable in a first direction substantially parallel to the axis of rotation to enable the dispenser head to pass from the closed position to the dispensing position, and the dispenser head may also be movable in a second direction substantially opposite from the first direction to enable the dispenser head to pass from the dispensing position to the closed position.

In a further aspect, the dispenser head may be movable in a first direction substantially parallel to its axis of rotation to enable the dispenser head to pass from a locked position in which the dispenser head cannot be rotated relative to the receptacle to an unlocked position in which the dispenser head is free to rotate relative to the receptacle, and the dispenser head may be movable in a second direction substantially opposite from the first direction to enable the dispenser head to pass from the unlocked position to the locked position.

In an aspect, the receptacle may define a cavity enabling a hand to be passed beneath the outlet orifice of the dispenser head when the dispenser head is in the dispensing position.

In another aspect, the receptacle is configured to be capable of receiving a packaging and applicator device. For example, the receptacle may be configured to receive a packaging and applicator device comprising an applicator and a packaging member. The packaging member may be configured to store the applicator device and to hold at least a dose of the product. In one embodiment, the packaging and applicator device may snap fasten to the receptacle.

Optionally, the volume of the receptacle may range from about 150 ml to about 600 ml. Alternately, the volume of the receptacle could be greater than or equal to about 400 ml. The volume of the receptacle, however, may be larger or smaller depending on the desired use.

In another aspect, the dispenser head may be movable to an intermediary position between the dispensing position and the closed position. The intermediary position may allow pressure inside the receptacle to equalize with pressure outside the receptacle. For example, the device may further comprise a micro-orifice to enable equalization of the pressure when the dispenser head is in the intermediary position. Optionally, the micro-orifice is located inside the receptacle above a predetermined maximum level of the product.

In a further aspect, the dispenser head may be configured to be moved between the dispensing position and the closed position by one of at least one non-axial movement of the dispenser head and a combination of at least one non-axial movement and at least one axial movement of the dispenser head. As used herein, the term "axial movement" means a pulling or pushing movement. For example, an axial movement of the dispenser head may comprise pushing or pulling the dispenser head along a direction, and a non-axial movement of the dispenser head may comprise rotating the dispenser head about the axis of rotation.

Optionally, the product may be dispensed in response to a reduction in the volume of the inside of the receptacle resulting from a pressure exerted on a portion of the receptacle situated at least in part under the dispenser head.

In another aspect, the invention includes a device for dispensing a powder. The device may comprise a variable-volume receptacle containing the powder. The receptacle may comprise a body. The device may also comprise a dispenser head associated with the receptacle, an outlet orifice in the dispenser head, and a dip tube. The dip tube may be configured to extend into the receptacle. The dispenser head may be movable between a dispensing position in which flow communication between the outlet orifice and an inside of the receptacle is established, and a closed position in which flow communication between the outlet orifice and the inside of the receptacle is interrupted. The powder may be dispensed in response to a reduction in the volume of the inside of the receptacle.

In still another aspect, the device may include a support coupled to the dispenser head. The dispenser head may be mounted such that the dispenser head does not rotate relative to the support and the dispenser head may be capable of moving in translation relative to the support to pass between the dispensing position and the closed position.

In a further aspect, the dispenser head may be rotatable about an axis of rotation that is substantially parallel to a flat surface when the bottom surface of the receptacle is placed on the flat surface.

In another aspect, the invention includes a device comprising a receptacle comprising an elastically compressible body of non-circular cross-section and a bottom surface, a support configured to be snap-fastened onto the body of the receptacle, a dip tube coupled to the support, and a rotary dispenser head configured to be mounted to rotate relative to the support about an axis of rotation that is not vertical when the bottom surface of the receptacle is placed on a horizontal plane surface. The device may also include an outlet orifice in the dispenser head and a cap for the dispenser head. The dispenser head may be movable between a dispensing position in which an outlet orifice of the dispenser head communicates with an inside of the receptacle and a closed position in which communication between the outlet orifice of the dispenser head and the inside of the receptacle is interrupted. The dispenser head may move from the dispensing position to the closed position by being rotated one half turn. Optionally, the dispenser head and the cap are configured such that the cap is capable of being coupled to the receptacle when the dispenser head is in the closed position and the cap cannot be coupled to the receptacle when the dispenser head is in the dispensing position.

In an additional aspect, the dip tube may extend substantially to the bottom of the inside of the receptacle when the dispenser head is coupled to the receptacle.

In still another aspect, the invention may include a product application system comprising a device for dispensing a product and a packaging and applicator device removably coupled to the receptacle of the device for dispensing a product. The packaging and applicator device may comprise an applicator and a packaging member. The packaging member may be configured to store the applicator device and to hold at least a dose of the product.

In yet another aspect, the invention includes a method of applying a product. The method may comprise providing a system including a device for dispensing a product and a packaging and applicator device coupled to the receptacle of the device for dispensing a product. The method may also include uncoupling the packaging and applicator device from the receptacle, dispensing a dose of product into the packaging member, contacting the applicator and the dose of product in the packaging member, and applying the dose of product to a part of a body.

The term "providing" is used in a broad sense, and refers to, but is not limited to, making available for use, enabling usage, giving, supplying, making, obtaining, getting a hold of, acquiring, purchasing, selling, distributing, possessing, making ready for use, and/or placing in a position ready for use.

In another aspect, a method of applying a product may include providing a device for dispensing a product, moving the dispenser head into the dispensing position, reducing the volume of the inside of the receptacle to dispense the product from the outlet orifice, and applying the product to a part of a body. For example, the reducing may comprise applying pressure to the outside of the receptacle (e.g., squeezing the receptacle).

In an aspect, the dispenser head may be rotatably mounted and capable of turning about an axis of rotation. The axis of rotation may be non-vertical and non-horizontal when the receptacle is placed on a horizontal plane surface. Thus, the angle of inclination of the outlet orifice may be modified by turning the dispenser head and thus preventing the product from being retained in an outlet channel of the dispenser head.

In an aspect of the invention, the receptacle may not need to have a pump and the user may be able to dispense only the quantity of product required merely by ceasing to reduce the inside volume of the receptacle as soon as the desired quantity of product has been dispensed.

In another aspect, the wall of the receptacle may be elastically deformable so that the receptacle can return to its initial shape once released by the user. When the receptacle is released, the product contained in the outlet channel of the dispenser head may be sucked back towards the receptacle, thereby preventing the product from drying out or oxidizing.

In still another aspect, the inside section of the dip tube may be selected so that when the receptacle returns to its initial shape after it has dispensed some product, and while the receptacle is substantially full, the dip tube is filled with air over the major fraction of its length. Thus, in the event of pressure being applied accidentally to the receptacle, unwanted dispensing of product may be prevented.

The dispenser head may include an outlet channel and at least a portion of the outlet channel (e.g., an end portion) may point upwards (e.g., away from the bottom surface of the receptacle) when the dispenser head is in its closed position. The outlet channel may be defined by a spout, for example. Thus, any residual product present in the outlet channel may not flow outwards but instead may flow towards the inside of the dispenser head, and thus may not soil the receptacle.

The axis of rotation of the dispenser head may extend in a vertical plane sloping upwards and to the side of the end portion of the outlet channel when the dispenser head is in its dispensing position and the receptacle is standing on a horizontal plane surface. The axis of rotation may form a non-zero angle of not more than 45° relative to the vertical, for example. The end portion of the outlet channel may slope upwards by more than 10° relative to the horizontal, for example, when the dispenser head is in its closed position and the bottom surface of the receptacle is placed on a horizontal plane surface.

The dispenser head may be off-center relative to the top portion of the receptacle and may turn (e.g., rotate) relative to a support. For example, the dispenser head may be off-center relative to a portion of the support optionally used for mounting on the body of the receptacle. In the dispensing position with the outlet channel opening to the outside via at least one outlet orifice, a vertical line passing through the outlet orifice may not intersect the receptacle, at least in the top portion thereof, whereas in the closed position, a vertical line passing through the outlet orifice may intersect the receptacle. With this configuration, the user may be able to easily access the space situated beneath the outlet orifice in order to collect the dispensed product.

In an aspect of the invention, the dispenser head may be moved from its dispensing position to its closed position by being turned through half a turn about the axis of rotation. The rotation through half a turn may be performed in either direction, for example. Alternately, the rotation may need to be performed in only one direction.

In another aspect of the invention, the outlet channel of the dispenser head may point downwards (e.g., toward the bottom surface of the receptacle) when the dispenser head is in its dispensing position. This may make it possible to avoid any need to tilt the receptacle in order to dispense the product and may make it easier to empty the receptacle.

The device may include a cap suitable for being fixed on the receptacle when the dispenser head is in its closed position. Numerous known pump devices do not have a cap because of the size of the pushbutton. The use of a cap may enable the structure of the dispenser head to be simplified, since it may reduce the possibility of product leaking even if the dispenser head is not locked in its closed position by locking means, unlike the pushbuttons in numerous known devices. Finally, when the dispenser head has a spout that points upwards in the closed position, the dispenser head may be easily received inside a cap that is relatively compact. In particular, the cap and the dispenser head may be arranged in such a manner that the cap cannot be mounted on the receptacle while the dispenser head is in the dispensing position.

The dispenser head may turn relative to a support which may be coupled to the body of the receptacle or which may be formed integrally therewith. When the support is coupled to the body of the receptacle, it may be held in place by snap-fastening or by being screwed thereon. Such a configuration may make it possible to reuse the dispenser head.

Optionally, the dispenser head may be coupled to the support by snap-fastening or by any other means.

The support may include at least one portion in relief (e.g., a projection or an indentation) enabling the user to position the dispenser head in at least one predetermined position (e.g., the dispensing position and/or the closed position). In particular, the support may have at least one projection and the dispenser head may have at least two pairs of ribs. The ribs in each pair may be suitable for taking up positions on either side of the projection when the dispenser head is in its position corresponding to the ribs (which position may be the dispensing position and/or the closed position). This passage of the projection over one or other of the above-mentioned ribs may provide a hard point that is felt by the user, thus reassuring the user that the dispenser head is properly positioned. Where appropriate, passage of the projection over one or other of the ribs may also be accompanied by an audible click.

The dip tube may be fixed to a support relative to which the dispenser head turns. In a variant, the dip tube may be secured to the body of the receptacle, particularly when the dispenser head is mounted on a support suitable for being removably fitted to the body of the receptacle. The receptacle may be filled with product and closed by a removable stopper.

The dip tube may communicate with the dispenser head so as to avoid a mix of air with the product flowing in the dip tube to avoid the formation of foam.

In an aspect, the receptacle may be generally flat in shape and may define two major faces which may be plane or somewhat convex, for example, and which may be squeezed together by the user in order to dispense the product. In a variant, or in addition, the receptacle may include one or more bellows enabling the inside volume of the receptacle to be varied and enabling the pressure inside the receptacle to be raised above ambient so as to cause the product to rise inside the dip tube and the dispenser head of the dispenser. By actuating the bellows, the volume of the interior of the receptacle may be decreased and the pressure inside may be increased.

In an embodiment with the dispenser head rotatably mounted, the dispenser head may be moved in a direction parallel to its axis of rotation to pass from a position in which the outlet orifice is isolated from the inside of the receptacle to a position in which the outlet orifice is capable of communicating with the inside of the receptacle, and vice versa.

Optionally, the dispenser head may be moved in a direction parallel to its axis of rotation to pass from a locked position in which the dispenser head is prevented from turning relative to the receptacle to an unlocked position in which the dispenser head is capable of being turned relative to the receptacle, and vice versa. Thus, it may be possible, for example, to lock the dispenser head in the closed position or in the dispensing position.

In a particular embodiment, the receptacle may define a cavity enabling a hand to be passed beneath the outlet orifice of the dispenser head when the dispenser head is in its dispensing position. In such an embodiment, a vertical line passing through the outlet orifice may intersect the receptacle, and in particular the bottom portion thereof when the dispenser head is in its dispensing position.

The receptacle may be shaped so as to be capable of receiving an independent packaging and applicator device.

In another aspect, the dispenser head may be moved about an axis of rotation that is horizontal when the receptacle is standing on a horizontal plane surface.

Optionally, the volume of the receptacle may lie in the range of from about 150 milliliters (ml) to about 600 ml. For example, the volume of the receptacle may be greater than or equal to about 200 ml, or indeed greater than or equal to about 300 ml, or indeed greater than or equal to about 400 ml.

In a particular embodiment, the dispenser head may occupy an intermediary position between the dispensing position and the closed position for allowing the pressure inside the receptacle to be substantially equal to the pressure outside. The device may comprise a micro-orifice for allowing the pressure inside the receptacle to equalize with the pressure outside of the receptacle. For example, this micro-orifice may emerge inside the receptacle above the product level.

In another aspect, the invention may include a device for dispensing a product in liquid or powder form. The device may comprise a variable-volume receptacle, a dip tube, and a dispenser head capable of occupying at least a dispensing position in which communication is established between an outlet orifice and the inside of the receptacle, and a closed position in which the communication is interrupted. The dispenser head may be moved from the dispensing position to the closed position not only by being axially pushed or pulled. The product may be dispensed in response to the inside volume of the receptacle being reduced by a pressure exerted on a portion of the receptacle situated at least in part under the dispenser head. Such a device may be more compact than a receptacle comprising a bellows in its top part.

The dispenser head may be rotatable about an axis of rotation which is not vertical and not horizontal when the receptacle is placed on a horizontal plane surface, whereby turning the dispenser head modifies the inclination of the outlet channel. Alternately, the dispenser head may be rotatable about an axis of rotation that is horizontal when the receptacle is standing on a horizontal surface.

In yet another aspect, the invention may include a device for packaging and dispensing a powder that comprises a variable-volume receptacle containing a powder, a dip tube, and a dispenser head capable of occupying at least a dispensing position in which communication is established between an outlet orifice and the inside of the receptacle, and a closed position in which said communication is interrupted. The powder may be dispensed in response to the inside volume of the receptacle being reduced.

The dispenser head need not be rotatably mounted and it may be capable of passing from a dispensing position to a closed position, and vice versa, by being moved in translation relative to a support.

The axis of rotation may not be vertical when the receptacle is placed on a horizontal surface, whereby turning the dispenser head modifies the inclination of an outlet channel.

In another embodiment, the dispenser head may be rotatable about an axis of rotation that is horizontal when the receptacle is standing on a horizontal plane surface.

BRIEF DESCRIPTION OF THE DRAWINGS

Aside from the arrangements set forth above, the invention may comprise any number of other arrangements. The accompanying drawings are included to provide a further understanding of the invention and are incorporated in and constitute a part of this specification. The drawings illustrate exemplary embodiments of the invention and together with the description, serve to explain certain principles. In the drawings.

MORE DETAILED DESCRIPTION OF EXEMPLARY EMBODIMENTS

Figure 1:
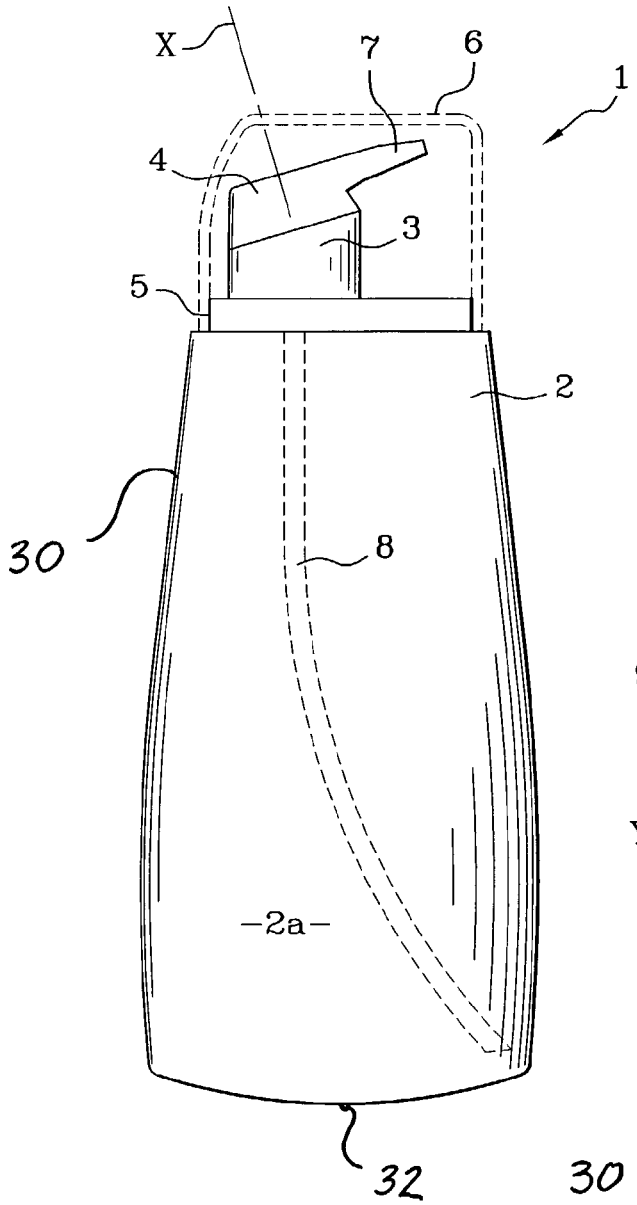
FIG. 1 is a view of an exemplary embodiment of a device according to the invention with the dispenser head in the closed position.

Reference will now be made in detail to exemplary embodiments of the invention, examples of which are illustrated in the accompanying drawings. Wherever possible, the same reference numbers are used in the drawings and the description to refer to the same or like parts.

FIG. 1 shows a packaging and dispenser device 1 that comprises a receptacle 2 for containing a product. For example, the product may be a liquid product or a powder product. When the product is a liquid, the liquid may have a consistency that is more or less viscous. In an embodiment, the receptacle 2 may contain a body lotion, a shampoo, a liquid soap, a makeup-removing oil, a hair care product, as well as many other types of products.

The receptacle 2 may comprise a body 30 and a bottom surface 32. In an embodiment, the volume of the inside of the receptacle 2 may range from about 150 ml to about 600 ml. In another embodiment, the volume of the inside of the receptacle may be about 400 ml. One of ordinary skill in the art would appreciate, however, that the volume of the inside of the receptacle could be larger or smaller depending on the desired application. The receptacle 2 may be stable when its bottom surface 32 is resting on a horizontal plane surface.

The body 30 of the receptacle 2 may be made out of a flexible and optionally transparent wall. For example, the body 30 may be made of polyethylene, polyvinylchloride, polyethylene terephthalate, or polyamide, with this list not intended to be limiting. The body 30 of the receptacle 2 may be made with a noncircular cross-section that is generally oblong, which defines two somewhat convex major faces 2*a*. The faces 2*a* may be suitable for being squeezed together by the user so as to compress the body 30 of the receptacle 2 elastically and decrease the inside volume of the receptacle 2, thereby causing product to be dispensed in a manner described in greater detail below. When the body 30 of the receptacle 2 is released, the receptacle may return to its initial shape. In an embodiment, the body 30 of the receptacle 2 can be made by blow-molding.

The device 1 may also include a support 3 capable of being coupled to a top portion of the body 30 of the receptacle 2 and a dispenser head 4 having a spout 7. As shown in FIG. 3, the spout 7 may define an outlet channel 19 with an end portion 19*a* and a dispensing orifice 9 at an end of the outlet channel 19. The dispenser head 4 may be mounted to be rotatable relative to the support 3. The dispenser head 4 is shown in a closed position in FIG. 1 and in a dispensing position in FIG. 2. The dispenser head 4 may be generally off-center relative to a middle axis of the body 30 of the receptacle 2.

At its base, the support 3 may have a surface 5 capable of providing the receptacle 2 with a friction connection to hold a cap 6 when the dispenser head 4 is in the closed position. The dispenser head 4 and the cap 6 may be configured in such a manner as to prevent the cap 6 from being put into place while the dispenser head 4 is in the dispensing position.

Figure 2:
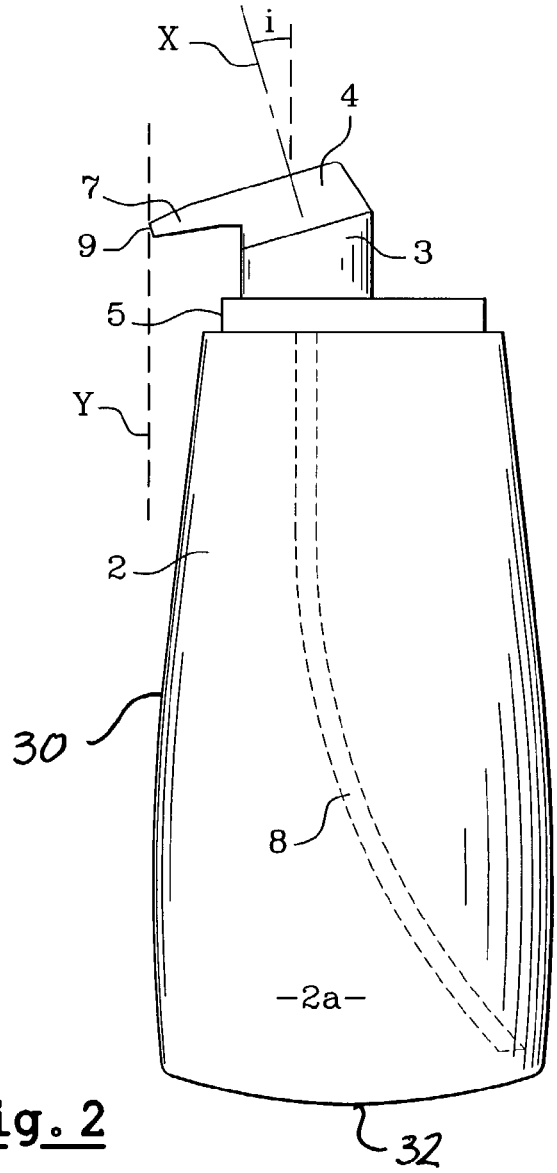
FIG. 2 is a view of the device of FIG. 1 with the dispenser head in the dispensing position.
Figure 3:
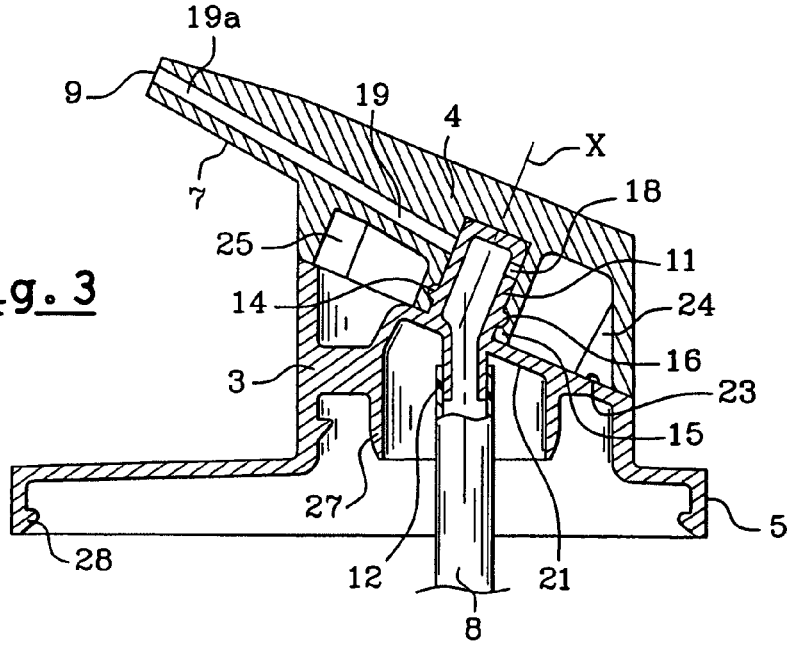
FIG. 3 is a partial cross-sectional view of the device of FIGS. 1 and 2.

As shown in FIGS. 1 and 2, while in the dispensing position, the dispenser head 4 may be in communication with a dip tube 8 extending into the receptacle 2. In an embodiment, the dip tube 8 may extend substantially to the bottom surface 32 of the receptacle 2.

The dispenser head 4 may be rotatable about an axis of rotation X that is at a non-zero angle i relative to the vertical. The axis of rotation X may extend obliquely upwards and away from the spout 7 when the dispenser head is in its closed position.

In an embodiment, the dispenser head 4 can be brought from the closed position to the dispensing position, or vice versa, by being turned through 180° about the axis X. In the example shown, it can be turned in either direction, but it would not go beyond the ambit of the present invention to provide a support and a dispenser head with means allowing turning in one direction only in order to pass from the closed position to the dispensing position.

In the dispensing position, a vertical line Y passing through the outlet orifice 9 may be offset from the receptacle 2 and may not intersect the receptacle 2. Thus, the receptacle 2 may not get in the user's way while the user is dispensing the product from the spout 7.

As can be seen in FIG. 3, the support 3 may have a wall 11 circularly cylindrical about the axis X. The wall 11 may be closed on top and may communicate internally at its bottom end with an endpiece 12 on which the dip tube 8 may be mounted. An annular bead 14 may be made on a radial outer surface of the wall 11. The dispenser head 4 may have an assembly skirt 15 including an annular groove 16 at a bottom portion thereof configured to snap-fasten on the bead 14. A radial orifice 18 may pass through the wall 11. The radial orifice 18 may be situated diametrically opposite from the internal channel 19 when the dispenser head 4 is in the closed position. Thus, when the dispenser head 4 is turned through half a turn in order to move into the dispensing position, the outlet channel 19 may open out in register with the orifice 18 and communicate therewith to enable the product contained in the receptacle 2 to reach the outlet orifice 9 when the user squeezes the receptacle 2 in order to cause the product to rise up the dip tube 8. The fit between the wall 11 and the assembly skirt 15 may be tight, so when the dispenser head 4 is in the dispensing position, all of the product passing through the orifice 18 passes into the outlet channel 19, and when the dispenser head 4 is in the closed position, the orifice 18 is closed in a substantially leaktight manner by the assembly skirt 15. Naturally, it would not go beyond the ambit of the present invention for the means that enables the outlet channel 19 to communication with the inside of the receptacle 2 when the dispenser head is in its dispensing position and that isolates the outlet channel 19 from the inside of the receptacle 2 when the dispenser head is in the closed position to be made in some other way, for example, by using other shapes of faucet plug.

The support 3 may have a transverse wall 21 from which both the wall 11 and the endpiece 12 project. This transverse wall 21 may extend obliquely with respect to the bottom surface 32 and perpendicularly with respect to the axis X. The transverse wall 21 may include a portion in relief, such as a projection 23 for co-operating with pairs of ribs 24 and 25 formed on the dispenser head 4 whenever the dispenser head is in the closed position or in the dispensing position. For example, in the closed position, the projection 23 may be received between the two ribs 24. The user may feel the projection 23 passing over the ribs 24. Similarly, when the dispenser head 4 is in the dispensing position, the projection 23 may be received between the other two ribs 25.

The support 3 may have an internal sealing skirt 27 bearing in a leaktight manner against an off-center neck on the body 30 of the receptacle 2. The support 3 can be fixed to the body 30 of the receptacle 2 in numerous ways, for example, by snap-fastening using ribs 28. In a variant not shown, the support 3 can be formed integrally with the body 30 of the receptacle 2. In another variant described below, the dispenser head may turn relative to a support suitable for being releasably coupled to the body of the receptacle.

To use the device 1, the user may bring the dispenser head 4 into the dispensing position and squeeze the faces 2*a* so as to cause a decrease in the volume of the inside of the receptacle 2 and thereby cause the product to rise up the dip tube 8 and into the outlet channel 19. Once a desired quantity of product has been dispensed, the user may release the receptacle 2 and the receptacle 2 may return to its initial shape. This return of the receptacle 2 to its initial shape may be accompanied by the product contained in the outlet channel 19 and in the dip tube 8 being sucked back into the receptacle 2 together with an intake of air. The dip tube 8 may be purged of the product it previously contained. An inside section of the dip tube having an inside diameter of about 1.5 millimeters (mm), for example, may be small enough to ensure that the product does not rise automatically up the dip tube 8 as soon as the receptacle 2 has returned to its initial shape. The dispenser head 4 can then be moved into the closed position so that any residual quantity of product present in the outlet channel 19 will flow towards the inside of the outlet channel 19 instead of dripping outwards through the dispensing orifice 9.

Figure 4:
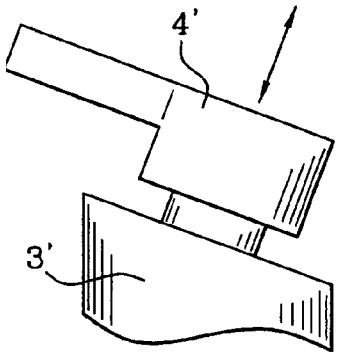
FIG. 4 is partial side view of another exemplary embodiment of a device according to the invention.

The dispenser head can also be made so as to be capable of being moved in translation in a direction substantially parallel to the axis X (see, e.g., FIG. 4). The embodiment shown in FIG. 4 shows a dispenser head 4' that can be pulled away from its support 3' or pushed against it. When the head 4' is pushed against the support 3', for example, it may co-operate with portions in relief on the support and be prevented from rotating. Optionally, when the head 4' is pulled away from the support 3', it can be turned so as to be brought from the closed position to the dispensing position and vice versa. In a variant, or additionally, movement of the dispenser head 4' parallel to the axis of rotation can be accompanied by the opening or closing of a passage that enables the outlet channel 19 to be put into communication with the inside of the receptacle 2.

In an embodiment not shown, the dispenser head may not be rotatable, but may be movable in translation to move the dispenser head between a closed position and a dispensing position, and vice versa. For example, such an embodiment may be used in particular when the product is a powder.

Figure 5:
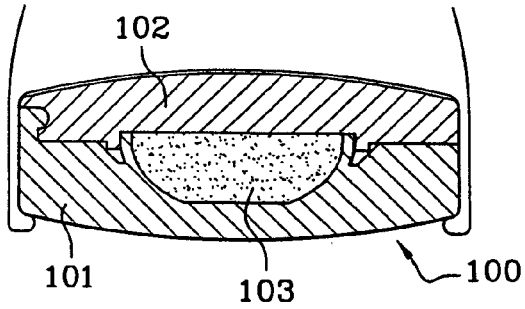
FIG. 5 is a cross-sectional view of an exemplary embodiment of a packaging and applicator device received in an exemplary embodiment of a receptacle.
Figure 6:
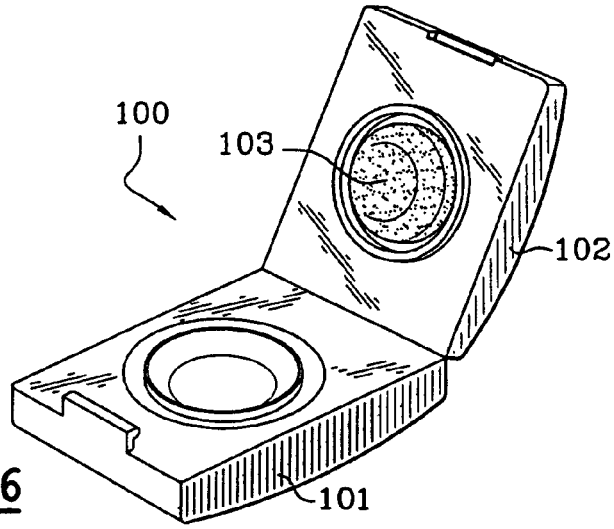
FIG. 6 shows the packaging and applicator device of FIG. 5 in an open position.

As shown in FIG. 5, the bottom portion of the receptacle 2 may be configured to receive an independent applicator or packaging and applicator device 100. The device 100, which is shown in the open position in FIG. 6, may comprise a packaging member including a first portion 101 and a second portion 102 suitable for co-operating with the first portion 101 to define a closed volume. The second portion 102 may include an applicator 103 of compressible porous material suitable for absorbing a product dispensed into a cavity defined by the first portion 101. The applicator 103 can be configured such that when the device 100 is in the closed position, the applicator 103 may be compressed at least in part inside the closed volume. Each time the device 100 is opened, the porous material may expand and hold substantially all of the product dispensed into the cavity defined by the first portion. The cavity defined by the first portion 101 may be refilled by using the device 1.

Figure 7:
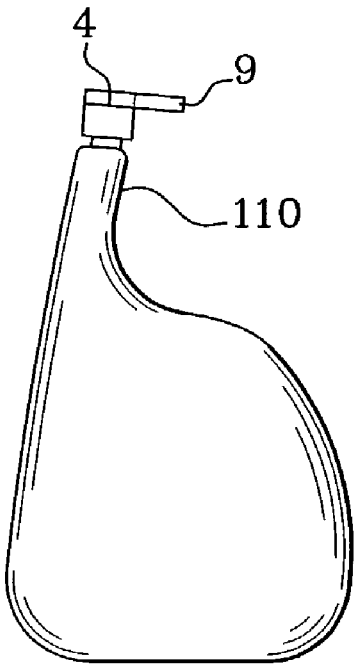
FIG. 7 is a view of another exemplary embodiment of a device according to the invention.

The receptacle 2 can be any of a variety of shapes, and specifically its body 30 can be of various shapes, without that going beyond the ambit of the present invention. For example, FIG. 7 shows an alternate embodiment of a receptacle with a dispenser head of the kind described above. The receptacle of FIG. 7 differs from the receptacle 2 of FIGS. 1 and 2 inasmuch as the receptacle of FIG. 7 defines a cavity 110, which provides a space for the hand of a user vertically beneath the outlet orifice 9 when the dispenser head is in the dispensing position.

Figure 8:
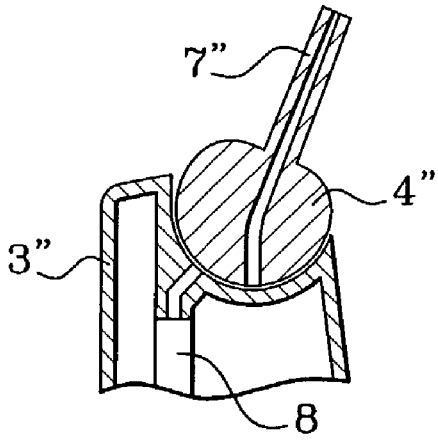
FIG. 8 is a partial schematic view of another exemplary embodiment of a device according to the invention.

Without going beyond the ambit of the present invention, it is possible to make the dispenser head in other ways. As shown in FIG. 8, for example, a dispenser head 4" may be mounted to pivot relative to a support 3" about an axis of rotation that is horizontal when the receptacle is standing on a horizontal plane surface. In the dispensing position, the spout 7" of the dispenser head 4" may point downwards and, in the closed position, the spout 7" may point upwards.

Figure 9:
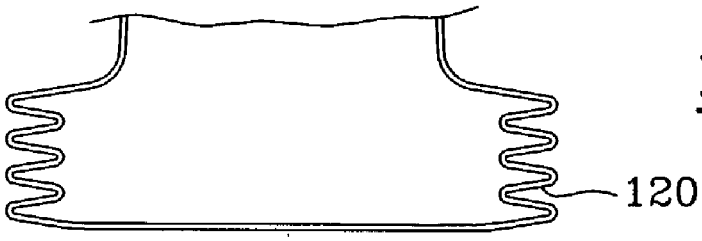
FIG. 9 is a partial schematic view of a receptacle including a bellows.

The means enabling the inside volume of the receptacle to be varied for the purpose of dispensing the product may be made differently as well. As shown in FIG. 9, for example, the receptacle may include a bellows 120 configured to enable the volume of the receptacle to be varied to dispense the product. It may also be possible to provide a baffle or a section reducer in the outlet channel or elsewhere on the path followed by the product.

Figure 10:
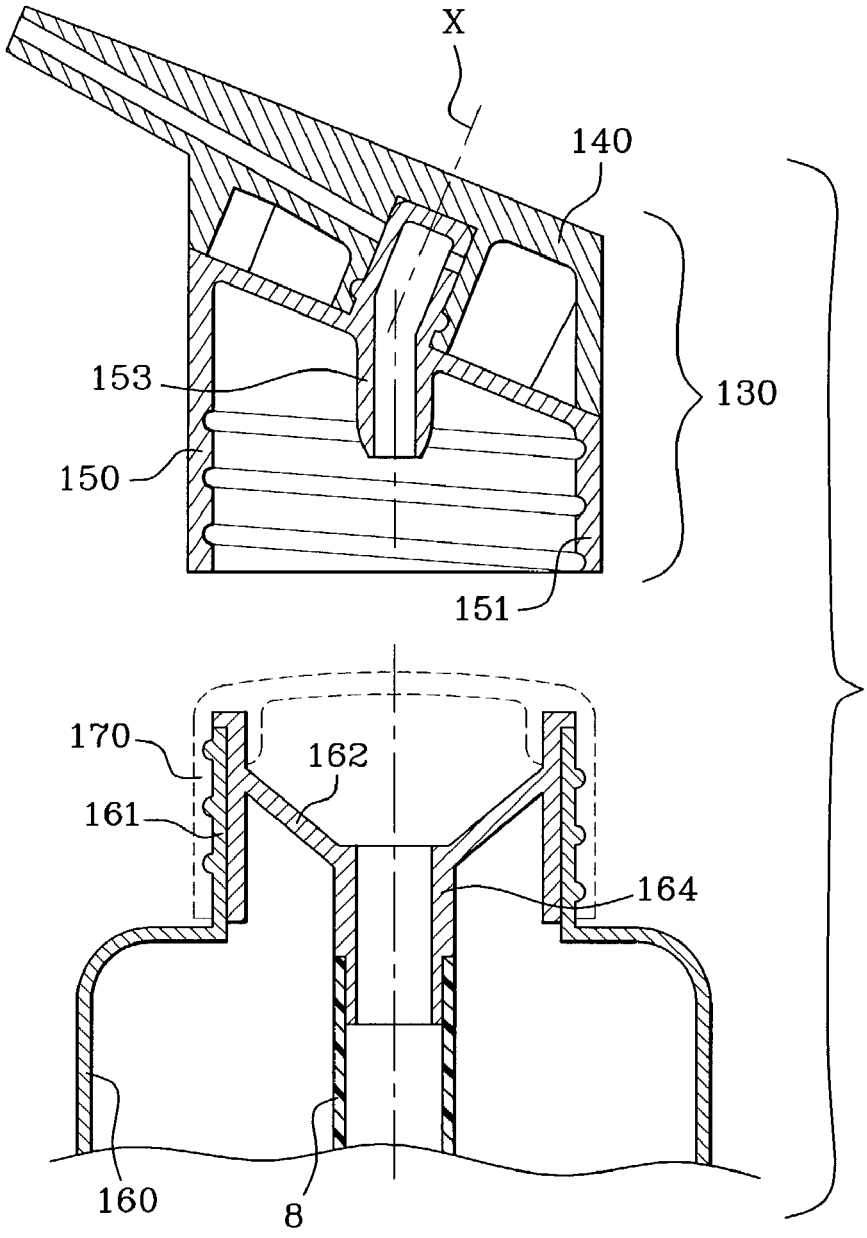
FIG. 10 is a partial cross-sectional view of another embodiment of a device according to the invention.
Figure 11:
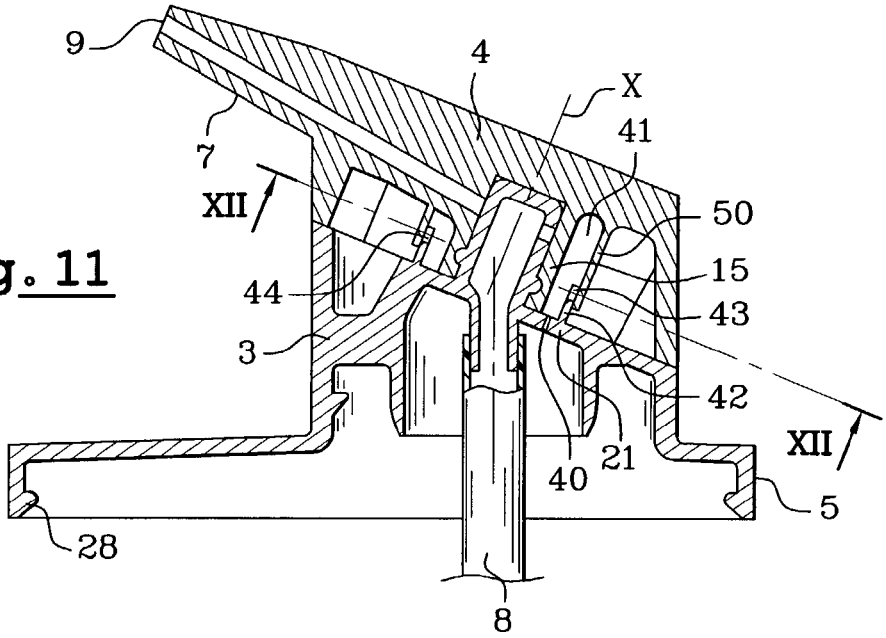
FIG. 11 is a partial cross-sectional view of another embodiment of a device according to the invention.
Figure 12:
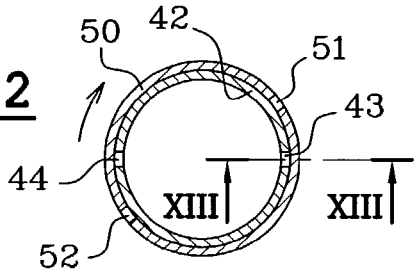
FIG. 12 is a partial cross-sectional view taken along the plane XII—XII of FIG. 11.
Figure 13:
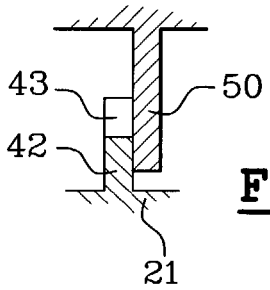
FIG. 13 is a cross-sectional view taken along the plane XIII—XIII of FIG. 12.
Figure 14:
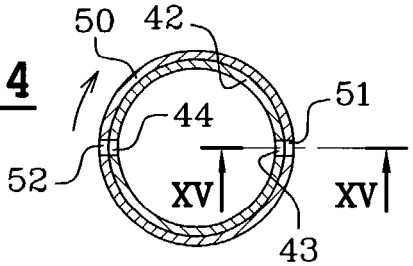
FIGS. 14 and 16 are views similar to FIG. 12 with the dispenser head of FIG. 11 in different positions.
Figure 15:
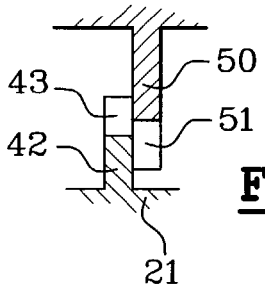
FIG. 15 is a cross-sectional view taken along the plane XV—XV of FIG. 14.

As shown in FIG. 10, the dispenser head may be rotatable relative to a support to which the dispenser head is removably fixed on a receptacle body. FIG. 10 shows an assembly 130 comprising a dispenser head 140 and a support 150. The dispenser head 140 may be identical to the above-described dispenser head 4 or it may be different. The support 150 differs from the support 3 described above in particular by the presence of an assembly skirt 151 having an inside thread that is suitable for screwing onto a neck 161 of a receptacle body 160. An insert 162 for coupling a dip tube 8 may be inserted in the neck 161. The support 150 may have an endpiece 153 suitable for engaging in a leaktight manner in a duct 164 in the bottom of the insert 162 when the support is screwed onto the neck 161.

The receptacle body 160 may be delivered together with the insert 162, filled with a product and closed by a removable cap 170 (shown in dashed lines in FIG. 10). After the cap 170 has been removed, the support 150 may be screwed onto the receptacle body and the dispenser head 140 can then be used in the same manner as the above-described dispenser head 4.

FIGS. 11 to 16 show another embodiment of a dispenser head and support. In this embodiment, the dispenser head and support are configured to allow a balancing of the pressure between the inside and the outside of the receptacle when turning the dispenser head. The support 3 may include a transverse wall 21 pierced with a micro-orifice 40, which allows communication between the interior of the receptacle and the inner space 41 of the dispenser head. The transverse wall 21 may comprise a cylindrical skirt 42 provided with two slots 43 and 44 diametrically opposed from one another (see FIGS. 12 to 16). Slots 43 and 44 have a length smaller than that of skirt 42.

The dispenser head may be provided with a cylindrical skirt 50 that contacts in a sealed manner the skirt 42 in the closed position. Along at least a part of its length, the skirt 50 may include two slots 51 and 52 diametrically opposed from one another. In the closed position (see FIGS. 11 to 13), the skirts 42 and 50 may be engaged in a sealed manner and the slots 43 and 44 may not be in register with the slots 51 and 52. By turning the dispenser head 4 relative to support 3, for example, in a clock wise direction, an intermediary position may be reached (see FIGS. 14 and 15) where slots 43 and 44 are respectively in register with slots 51 and 52.

In this intermediary position, communication may be established between the inside and outside of the receptacle by means of the micro-orifice 40 and slots 43, 44, 51 and 52. The resulting possible flow of air may allow for the pressure inside of the receptacle and the pressure outside of the receptacle to be substantially equal. This pressure equalization may prevent product from flowing upon movement of the dispenser head to the dispensing position, which could otherwise result from the pressure in the interior of the receptacle being greater than the atmospheric pressure when the dispenser head is in the closed position.

Figure 16:
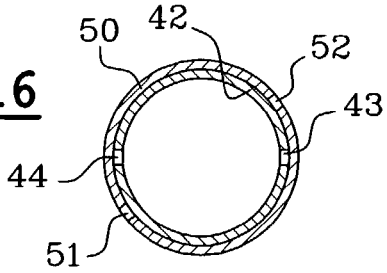

By further turning the dispenser head relative to the support, the dispenser head moves from the intermediary position to the dispensing position, as shown in FIG. 16. In this position, the skirt 50 has rotated about 180° relative to the closed position. Although slots 43 and 44 are not shown in register with slots 51 and 52, in another embodiment, they could be in register without preventing the product from flowing if the micro-orifice 40 is small enough.

The dispenser head may have shapes differing from those described above without that going beyond the ambit of the present invention. In this respect, the word "head" should not be interpreted as being limiting, but on the contrary should be interpreted as being very broad in scope, so as to cover all types of dispenser members.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A device for dispensing a product, comprising:

a variable-volume receptacle for containing the product, the receptacle comprising a body and a bottom surface;

a dispenser head associated with the receptacle, the dispenser head being rotatable about an axis of rotation, the axis of rotation being nonperpendicular to and nonparallel to a flat surface when the bottom surface of the receptacle is placed on the flat surface;

an outlet orifice in the dispenser head; and a dip tube configured to extend into the receptacle, wherein the dispenser head is movable between a dispensing position in which flow communication between the outlet orifice and an inside of the receptacle is established, and a closed position in which flow communication between the outlet orifice and the inside of the receptacle is interrupted, wherein the product is dispensed from the outlet orifice in response to a reduction in the volume of the inside of the receptacle, and wherein a vertical line passing through the outlet orifice and being perpendicular to a plane including the bottom surface of the receptacle does not intersect at least a top portion of the receptacle when the dispenser head is in the dispensing position, and wherein the vertical line intersects the receptacle when the dispenser head is in the closed position.

2. The device according to claim 1, further comprising the product in the receptacle, the product comprising a liquid.

3. The device according to claim 1, further comprising the product in the receptacle, the product comprising a powder.

4. The device according to claim 1, wherein the dip tube comprises an inside section configured so that when the receptacle returns to an initial shape after dispensing product and the receptacle is substantially full of product, the dip tube is filled with air over a major fraction of its length.

5. The device according to claim 1, wherein the device does not comprise a pump.

6. The device according to claim 1, wherein the dispenser head comprises an outlet channel flow coupled to the outlet orifice, and wherein at least a portion of the outlet channel extends in a direction pointing towards the outlet orifice and away from a plane including the bottom surface of the receptacle when the dispenser head is in the closed position.

7. The device according to claim 6, wherein the outlet channel has an end portion, and wherein the end portion extends in the direction pointing towards the outlet orifice and away from the plane including the bottom surface of the receptacle when the dispenser head is in the closed position.

8. The device according to claim 7, wherein the axis of rotation is in a plane oblique with respect to a plane including the bottom surface of the receptacle, the plane of the axis of rotation being angled towards the end portion of the outlet channel when the dispenser head is in the dispensing position.

9. The device according to claim 1, wherein the axis of rotation makes a nonzero angle of not more than 45° relative to the vertical when the bottom surface of the receptacle is placed on a horizontal plane surface.

10. The device according to claim 1, further comprising a support configured to be coupled to the receptacle, the dispenser head being rotatable relative to the support.

11. The device according to claim 1, wherein the dispenser head is off-center relative to a top portion of the body of the receptacle.

12. The device according to claim 1, wherein the dispenser head is movable from the dispensing position to the closed position by rotating the dispenser head through one half turn about the axis of rotation.

13. The device according to claim 1, wherein the dispenser head comprises an outlet channel flow coupled to the outlet orifice, and wherein the outlet channel extends in a direction towards the outlet orifice and towards a plane including the bottom surface of the receptacle when the dispenser head is in the dispensing position.

14. The device according to claim 1, further comprising a cap for the dispenser head, the cap being capable of being coupled to the receptacle when the dispenser head is in the closed position.

15. The device according to claim 1, further comprising a support coupled to the receptacle, the dispenser head being rotatable relative to the support.

16. The device according to claim 15, wherein the support is coupled to the body of the receptacle by one of snap-fastening and being screwed thereon.

17. The device according to claim 1, further comprising a support integral with the body of the receptacle, the dispenser head being rotatable relative to the support.

18. The device according to claim 1, further comprising a support, the dispenser head being fixed to the support by snap-fastening.

19. The device according to claim 1, further comprising a support, the dispenser head being rotatable relative to the support, and wherein the support includes at least one portion in relief enabling the dispenser head to be positioned in a predetermined position.

20. The device according to claim 19, wherein the predetermined position comprises at least one of the dispensing position and the closed position.

21. The device according to claim 20, wherein the support enables the dispenser head to be positioned accurately both in the closed position and in the dispensing position.

22. The device according to claim 20, wherein the support includes at least one projection and the dispenser head includes at least first and second pairs of ribs, the ribs in the first pair being configured to be positioned on opposing sides of the at least one projection when the dispenser head is in the dispensing position and the ribs in the second pair being configured to be positioned on opposing sides of the at least one projection when the dispenser head is in the closed position.

23. The device according to claim 1, further comprising a support, the dispenser head being rotatable relative to the support, the dip tube being fixed to the support.

24. The device according to claim 1, further comprising a support capable of being removably coupled to the body of the receptacle, wherein the dip tube is coupled to the body of the receptacle, and wherein the dispenser head is on the support.

25. The device according to claim 1, wherein the receptacle comprises at least one elastically deformable wall, the at least one elastically deformable wall being capable of deforming in response to a force and then returning to its initial shape upon removal of the force.

26. The device according to claim 1, wherein the receptacle comprises two major faces capable of being squeezed together to decrease the volume of an inside of the receptacle and thereby dispense the product from the receptacle.

27. The device according to claim 1, wherein the receptacle includes a bellows, the bellows enabling the volume of an inside of the receptacle to be varied.

28. The device according to claim 1, wherein the dispenser head is movable in a first direction substantially parallel to the axis of rotation to allow the dispenser head to pass from the closed position to the dispensing position, and wherein the dispenser head is movable in a second direction substantially opposite from the first direction to allow the dispenser head to pass from the dispensing position to the closed position.

29. The device according to claim 1, wherein the dispenser head is movable in a first direction substantially parallel to the axis of rotation to allow the dispenser head to pass from a locked position in which the dispenser head cannot be rotated relative to the receptacle to an unlocked position in which the dispenser head is free to rotate relative to the receptacle, and wherein the dispenser head is movable in a second direction substantially opposite from the first direction to allow the dispenser head to pass from the unlocked position to the locked position.

30. The device according to claim 1, wherein the receptacle defines a cavity enabling a hand to be passed beneath the outlet orifice of the dispenser head when the dispenser head is in the dispensing position.

31. The device according to claim 1, wherein the receptacle is configured to be capable of receiving a packaging and applicator device.

32. The device according to claim 1, wherein the volume of the receptacle ranges from about 150 ml to about 600 ml.

33. The device according to claim 32, wherein the volume of the receptacle is greater than or equal to about 400 ml.

34. A product application system, comprising:

the device according to claim 31, the receptacle containing the product; and a packaging and applicator device removably coupled to the receptacle, the packaging and applicator device comprising an applicator and a packaging member, the packaging member being configured to store the applicator device and to hold at least a dose of the product.

35. A method of applying a product, comprising:

providing the system according to claim 34;

uncoupling the packaging and applicator device from the receptacle;

dispensing a dose of product into the packaging member;

contacting the applicator and the dose of product in the packaging member; and applying the dose of product to a part of a body.

36. The device according to claim 1, wherein the dispenser head is movable to an intermediary position between the dispensing position and the closed position, the intermediary position allowing pressure inside the receptacle to equalize with pressure outside the receptacle.

37. The device according to claim 36, wherein the device further comprises a micro-orifice to enable equalization of the pressure when the dispenser head is in the intermediary position, the micro-orifice being located inside the receptacle above a predetermined maximum level of the product.

38. The device according to claim 1, wherein the dip tube extends substantially to the bottom of the inside of the receptacle when the dispenser head is flow coupled to the receptacle.

39. A method of applying a product, comprising:

providing the device of claim 1 with the product in the receptacle;

moving the dispenser head into the dispensing position;

reducing the volume of the inside of the receptacle to dispense the product from the outlet orifice; and applying the product to a part of a body.

40. The method according to claim 39, wherein the reducing comprises applying a force to the outside of the receptacle.

41. The device according to claim 1, wherein the receptacle contains a cosmetic product.

42. The device according to claim 1, wherein the dispensed head rotates between the dispensing position and the closed position on the same axial plane.

43. The device according to claim 1, wherein the dispensed head comprises a spout defining an outlet channel, the outlet orifice being disposed at an end of the outlet channel.

44. The device according to claim 1, wherein the dispenser head defines only one outlet orifice.

45. A device for dispensing a product, comprising:

a variable-volume receptacle for containing the product, the receptacle comprising a body and a bottom surface;

a dispenser head associated with the receptacle, the dispenser head being rotatable about an axis of rotation, the axis of rotation being nonperpendicular to and nonparallel to a flat surface when the bottom surface of the receptacle is placed on the flat surface;

a cap for the dispenser head;

an outlet orifice in the dispenser head; and a dip tube configured to extend into the receptacle, wherein the dispenser head is movable between a dispensing position in which flow communication between the outlet orifice and an inside of the receptacle is established, and a closed position in which flow communication between the outlet orifice and the inside of the receptacle is interrupted, wherein the cap is capable of being coupled to the receptacle when the dispenser head is in the closed position, wherein the product is dispensed from the outlet in response to a reduction in the volume of the inside of the receptacle, and wherein the cap and the dispenser head are configured such that the cap cannot be coupled to the receptacle when the dispenser head is in the dispensing position.

46. A device comprising:

a receptacle comprising an elastically compressible body of non-circular cross-section and a bottom surface;

a support configured to be snap-fastened onto the body of the receptacle;

a dip tube coupled to the support;

a rotary dispenser head configured to be mounted to rotate relative to the support about an axis of rotation that is not vertical when the bottom surface of the receptacle is placed on a horizontal plane surface;

an outlet orifice in the dispenser head; and a cap for the dispenser head, wherein the dispenser head is movable between a dispensing position in which an outlet orifice of the dispenser head communicates with an inside of the receptacle and a closed position in which communication between the outlet orifice of the dispenser head and the inside of the receptacle is interrupted, wherein the dispenser head moves from the dispensing position to the closed position by being rotated one half turn, and wherein the dispenser head and the cap are configured such that the cap is capable of being coupled to the receptacle when the dispenser head is in the closed position and the cap cannot be coupled to the receptacle when the dispenser head is in the dispensing position.

47. The device according to claim 46, wherein the dip tube extends substantially to the bottom of the inside of the receptacle when the support is snap-fastened onto the body of the receptacle.

48. A method of applying a product, comprising:

providing the device according to claim 46 with a product in the receptacle;

moving the dispenser head into the dispensing position;

compressing the receptacle to dispense the product from the outlet orifice; and applying the product to a part of a body.

49. The device according to claim 46, wherein the receptacle contains a cosmetic product.

* * * * *

UNITED STATES PATENT AND TRADEMARK OFFICE

CERTIFICATE OF CORRECTION

PATENT NO. : 7,168,598 B2
APPLICATION NO. : 10/232511
DATED : January 30, 2007
INVENTOR(S) : Jean-Louis H. Gueret It is certified that error appears in the above-identified patent and that said Letters Patent is hereby corrected as shown below:

Claim 42, col. 16, lines 61-62, “dispensed head” should read --dispenser head--.

Claim 43, col. 16, lines 64-65, “dispensed head” should read --dispenser head--.

Claim 45, col. 17, line 23, “the outlet in” should read --the outlet orifice in--.

Signed and Sealed this

Third Day of April, 2007

JON W. DUDAS
*Director of the United States Patent and Trademark Office*